US006454448B2

(12) United States Patent
Taniuchi et al.

(10) Patent No.: US 6,454,448 B2
(45) Date of Patent: Sep. 24, 2002

(54) HEAD LAMP FOR VEHICLE

(75) Inventors: Hitoshi Taniuchi; Teruo Koike, both of Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 15 days.

(21) Appl. No.: 09/785,545

(22) Filed: Feb. 16, 2001

(30) Foreign Application Priority Data

Feb. 18, 2000 (JP) ..... 2000-041969

(51) Int. Cl.[7] ..... F21V 7/09
(52) U.S. Cl. ..... 362/517; 362/539; 362/346
(58) Field of Search ..... 362/517, 518, 362/516, 539, 538, 299, 346

(56) References Cited

U.S. PATENT DOCUMENTS 4,772,987 A * 9/1988 Kretschmer et al. ..... 362/215
5,305,189 A * 4/1994 Sekiguchi ..... 362/297

FOREIGN PATENT DOCUMENTS

| | | |
|---|---|---|
| JP | 07078503 | 3/1995 |
| JP | 09219104 | 8/1997 |
| JP | 11339505 | 12/1999 |

* cited by examiner

*Primary Examiner*—Sandra O'Shea
*Assistant Examiner*—Hargobind S. Sawhney
(74) *Attorney, Agent, or Firm*—Weingarten, Schurgin, Gagnebin & Lebovici LLP

(57) ABSTRACT

There has been a problem that in a head lamp with a prior constitution, an utilization factor of luminous flux with respect to a light source is low and the head lamp with brightness commensurate with power consumption can be obtained. According to the invention, it can be realized a head lamp 1 for a vehicle wherein a first elliptic system reflecting surface 3 having an optical axis in the illuminating direction of the head lamp and arranging a primary focus on the light source 2 and a second elliptic system reflecting surface 4 arranging the primary focus on the same light source 2 and intersecting the optical axis at approximately right angle to the optical axis of the first elliptic system reflecting surface 3 are provided, the projection lens 6, corresponding to the secondary focus of the first elliptic system reflecting surface and the shield plate 5, as required are provided, and a parabolic system reflecting surface 7 approximately taking the secondary focus as a focus, corresponding to the secondary focus of the second elliptic system reflecting surface 4 and the shield plate and taking the optical axis as the approximately illuminating direction is provided], whereby the light shielded by the shield plate and the light from the light source which can not reach the reflecting surface and heretofore, has been invalid to form the light-distribution characteristic can be recovered, and the utilization factor of luminous flux to the light source 2 can be improved, thereby to be solve the problems.

5 Claims, 6 Drawing Sheets

HEAD LAMP FOR VEHICLE

BACKGROUND OF THE INVENTION

1. Field of the Invention

This invention relates to a head lamp a vehicle and more particularly to a constitution which further can be improved to the head lamp of type constituted by combining a reflecting surface, a shield plate, a elliptic system projection lens or the like such as spheroidal reflecting surface and referred to as a projector type, and the object of the invention is to provide the constitution of the head lamp for the vehicle.

2. Detailed Description of the Prior Art

FIG. 10 shows an example of a constitution of a prior projector type head lamp 90, and a light source 92 is arranged at a position of a primary focus f1 of an elliptic system reflecting surface 91 such as a spheroidal reflecting surface of which major axis is aligned with an illuminating direction X. Moreover, a shield plate 93 is provided at the vicinity of a position of a secondary focus f2, which shields the approximate half of the lower of luminous flux converged into the secondary focus f2 from said elliptic system reflecting surface 91.

According to this constitution described above, since a cross-section shape of luminous flux in the vicinity of said shield plate 93 becomes a approximately half-round shape of last quarter, this shape is projected in the illuminating direction in the condition which becomes a half-round shape of first quarter that the upper and the lower are reversed when projecting this shape in the illuminating direction by a projection lens 94 having a focus f3 at the vicinity of the shield plate 93.

Therefore, it can be obtained a light-distribution pattern optimal for a passing beam including perfectly no upward light which becomes a factor by which the glare is caused to an on-coming vehicle. However, modification is given on the shape of the shield plate 93 so as to produce the appropriate upward light on the left side when being supposed to pass in the left side in order to facilitate to recognize pedestrians or road signs on the side of a roadside at the occasion of an embodiment in practice.

However, there has been a problem that in the head lamp 90 with the prior constitution, the approximate half of the reflected light from the elliptic system reflecting surface 91 is shielded by the shield plate 93 as is apparent from description described above, as a result, an utilization factor of luminous flux with respect to a light source 92 is reduced and the head lamp becomes poor in intensity for power consumption. Moreover, the light emitted to the front side (the illuminating direction) from the light source 92, which can not reach the elliptic system reflecting surface, does not contribute formation of a light-distribution characteristic and the utilization factor of luminous flux also is reduced in this point.

SUMMARY OF THE INVENTION

The present invention can solve the problems by providing a head lamp for a vehicle as specified means for solving the prior problems described above, wherein a first elliptic system reflecting surface_having an optical axis in the illuminating direction of the head lamp and arranging a primary focus on the light source and a second elliptic system reflecting surface arranging the primary focus on the same light source and intersecting the optical axis at approximately right angle to the optical axis of said first elliptic system reflecting surface are provided, the projection lens, corresponding to the secondary focus of said first elliptic system reflecting surface and the shield plate, as required are provided, and a parabolic system reflecting surface approximately taking the secondary focus as a focus, corresponding to the secondary focus of said second elliptic system reflecting surface and the shield plate and approximately taking the optical axis as the illuminating direction is provided.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENT

Figure 1:
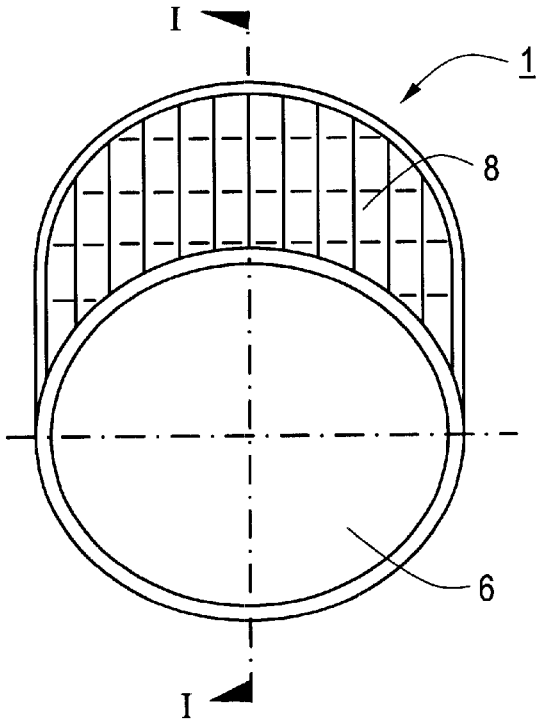
FIG. 1 is a front elevation showing a first embodiment of a head lamp for a vehicle according to the invention.
Figure 2:
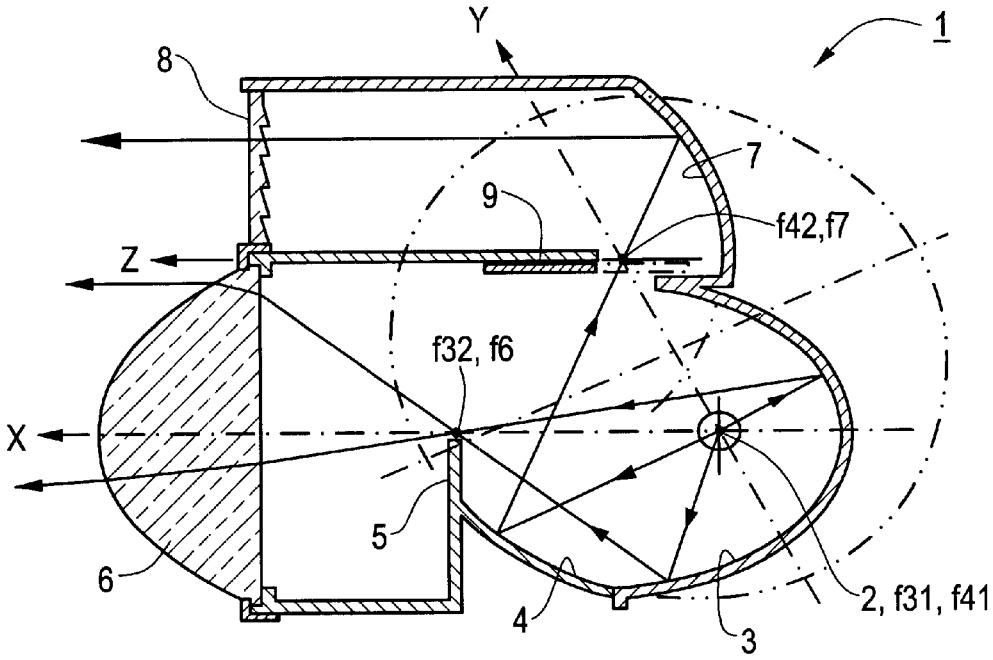
FIG. 2 is a sectional view along line I—I in FIG.1.

Secondly, the invention will be described in detail based on embodiments shown in the drawings. FIG. 1 to FIG. 3 show a first embodiment of a head lamp for a vehicle 1 (hereinafter abbreviated as a head lamp 1) according to the invention, and in the invention, a head lamp 1 is provided with two reflecting surfaces of a first elliptic system reflecting surface 3 and a second elliptic system reflecting surface 4 formed into an elliptic system such as the spheroidal reflecting surface, for example, to one light source 2 such as a halogen lamp, a metal halide discharge lamp, or example.

In said first elliptic system reflecting surface 3, said light source 2 is taken as a primary focus f31 and a major axis is aligned with the illuminating axis X. Therefore, the secondary focus f32 also would be on the illuminating axis X, and the reflected light from the first elliptic system reflecting surface 3 is converged on the secondary focus f32.

Moreover, a shield plate 5 is provided at the vicinity of said secondary focus f32, and the approximate half of the lower of the reflected light from the first elliptic system reflecting surface 3 converged into the secondary focus f2 as is described in the prior example approximately is shielded, and a cross-section shape of this shielded luminous flux is projected toward the illuminating direction X by a projection lens 6 having a focus f6 at the vicinity of said shield plate 5.

Here, an utilizing condition of the reflected light from said first elliptic system reflecting surface 3 will be discussed. Since the major portion of the reflected light from the half of the lower is shielded by the shield plate 5 as described above, it has not been utilized as light for the head lamp 1 substantially.

Accordingly, in the first embodiment, the second elliptic system reflecting surface 4 is provided on the position corresponding to the half of the lower of the first elliptic system reflecting surface 3, and at this point of time, a major axis Y of the second elliptic system reflecting surface 4 is positioned at the major axis of said first elliptic system reflecting surface 3, that is, the upper of a point intersecting at approximately right angle to the illuminating axis X, while the primary focus f1 of this second elliptic system reflecting surface 4 also is positioned at the position of the light source 2 as is the first elliptic system reflecting surface 3.

Therefore, in the invention, a secondary focus f42 of said second elliptic system reflecting surface 4 is produced on the major axis Y, and the parabolic system reflecting surface 7 such as the paraboloid of revolution with an axis Z approximately parallel to said illuminating axis X, taking the secondary focus f42 as a focus f7, is provided. Accordingly, this parabolic system reflecting surface 7 reflects the light converging on said secondary focus f42 in the direction of the illuminating axis X as an approximately parallel light beam. Moreover, a lens 8 is provided within the luminous flux of the light from said parabolic system reflecting surface 7. Moreover, a lens cut can be provided on this lens 8 to form the light-distribution characteristic freely.

At this point of time, the direction of the reflected light obtained by adjusting the position between the secondary focus f42 of said second elliptic system reflecting surface 4 and the focus f7 of the parabolic system reflecting surface 7 can be controlled, and the parallel light beam reflected on the parabolic system reflecting surface 7 becomes the passing beam when setting the secondary focus f42 so as to position it at the upper of the focus f7, for example.

Moreover, in the first embodiment, since said parabolic system reflecting surface 7 has the shape of the approximate half of the upper of the paraboloid of revolution, the parallel light beam also can be the passing beam, when setting the secondary focus f42 on a position approached toward the front. Therefore, the position between both focus of f42 and f7 can be adjusted in response to the light-distribution characteristic required for the head lamp 1 as required.

Figure 3A:
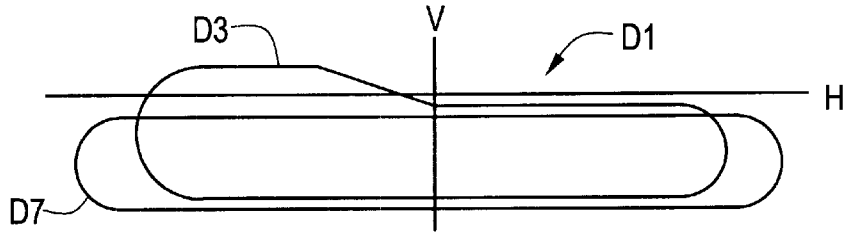
FIG. 3 is an illustration schematically showing a light-distribution characteristic of the first embodiment of the head lamp for the vehicle according to the invention.

FIG. 3A shows an example of the light-distribution characteristic of the head lamp 1 according to the invention constituted as described above, and the light-distribution characteristic D1 is obtained by superimposing the light-distribution characteristic D3 formed by the reflected light from the first elliptic system reflecting surface 3 and the light-distribution characteristic D7 formed by the reflected light from the parabolic system reflecting surface 7 via the second elliptic system reflecting surface 4.

Since said light-distribution characteristic D3 is formed the reflected light from the half of the upper of the first elliptic system reflecting surface 3 mainly, it basically has the same shape as the light-distribution characteristic in the prior projector type head lamp, moreover, it is not very different in the amount of light.

In contrast to this, since the light-distribution characteristic D7 is formed with the reflected light from this second elliptic system reflecting surface 4obtained by forming the second elliptic system reflecting surface 4 on the portion of the first elliptic system reflecting surface 3 shielded by the shield plate 5 in the projector type head lamp of the prior example, the intensity of light obtained by adding the light of the projector type head lamp of the prior example thereto can be realized.

Moreover, it also is possible to provide on the front of the light source 2 at the position which can not interfere with the reflected light from the second elliptic system reflecting surface 4, such as the vicinity or the like of the secondary focus f2 of the second elliptic system reflecting surface 4, when providing the second elliptic system reflecting surface 4. Therefore, according to the constitution of the head lamp 1 of the invention, the utilization factor of luminous flux to the light source 2 can be improved, and the extremely bright head lamp also can be realized in the case where using the light source 2 with the same power consumption.

Figure 3B:
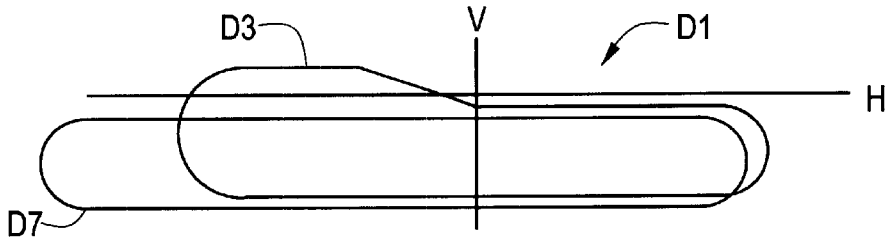

Here, further discussing FIG. 3A, since the illuminating direction of the light-distribution characteristic D7 is formed by the parabolic system reflecting surface 7 of which focus f7 2 is approximately aligned with the secondary focus f42, which is a point source substantially, of the second elliptic system reflecting surface 4, the direction of axis Z is changed, taking said the focus f7 as the center, thereby the change to be performed freely. FIG. 3B is a view showing the condition of the case where shifting axis Z described above from side to side within the plane horizontal to the illuminating axis X, and is shown in the example where being attempted so as to be able to further recognize visually the roadside by shifting to the left side, supposing that the head lamp 1 is one for passing in the left side in the drawing.

Moreover, a reference character 9 in FIG. 2 shows a shutter, and this shutter 9 can be moved by a solenoid (not shown) or the like freely, for example, whereby the reflected light from the second elliptic system reflecting surface 4 which reaches the parabolic system reflecting surface 7 can be opened and closed freely. Moreover, the parabolic system reflecting surface 7 is set for the illuminating direction X.

Figure 3C:
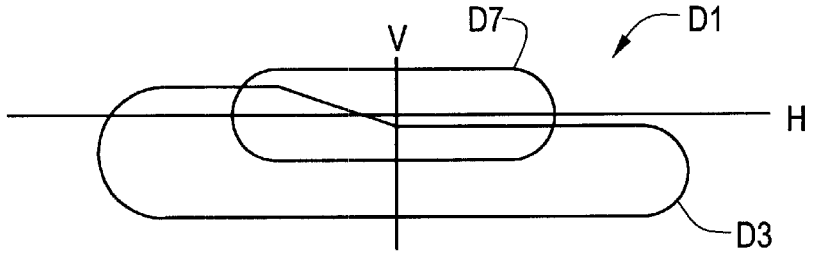
Figure 3D:
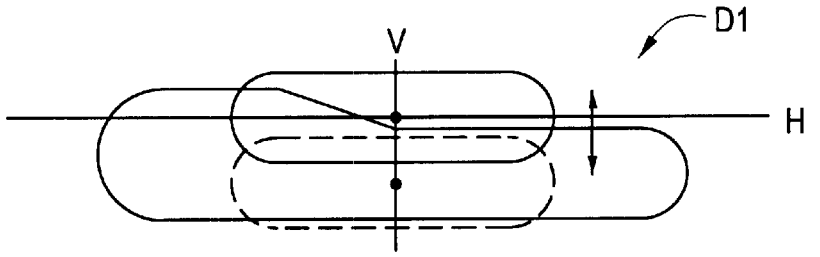

According to this constitution described above, since the light-distribution characteristic D7 is projected to a front direction as shown in FIG. 3(C), a light distribution for driving can be obtained in the overlapped light-distribution characteristic when the shutter 9 is opened, and the light-distribution characteristic D7 is varnished and a light distribution for the passing beam can be obtained in the total light-distribution characteristic when the shutter 9 is shielded.

Furthermore, since the illuminating direction of the reflected light from the parabolic system reflecting surface 7 can be changed by adjusting a mutual position between the secondary focus f42 of the second elliptic system reflecting surface 4 and the focus f7 of the parabolic system reflecting surface 7, the second elliptic system reflecting surface 4 may be moved instead of the described-above shutter 9, and the light-distribution characteristic D7 is moved and to be switched to the driving beam and the passing beam in this case as described above.

FIG. 4 to FIG. 7 are views showing a second embodiment and a third embodiment of the head lamp 1 according to the invention, and in the invention, the second elliptic system reflecting surface 4 can be provided at a free position to the first elliptic system reflecting surface 3, as far as the reflecting surface 3 and 4 can not cause the mutual interference to such an extent as to make formation of the light-distribution characteristic impossible.

Figure 4:
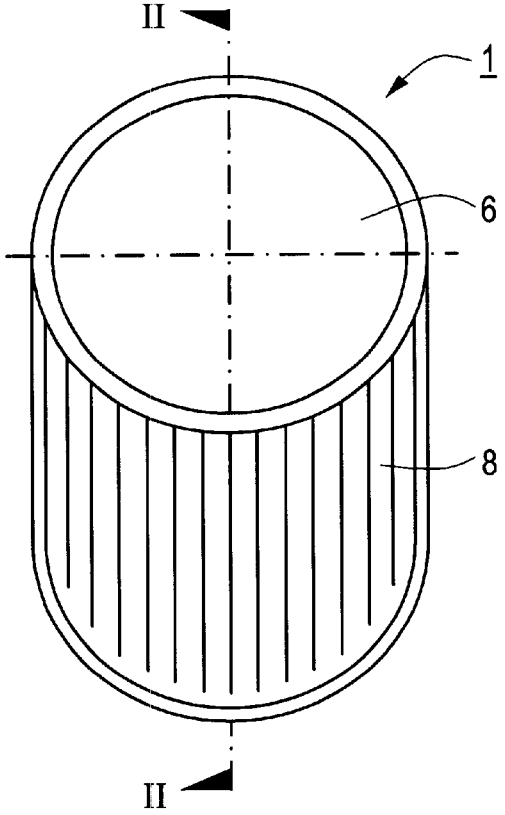
FIG. 4 is a front elevation showing a embodiment of the head lamp for the vehicle according to the invention.
Figure 5:
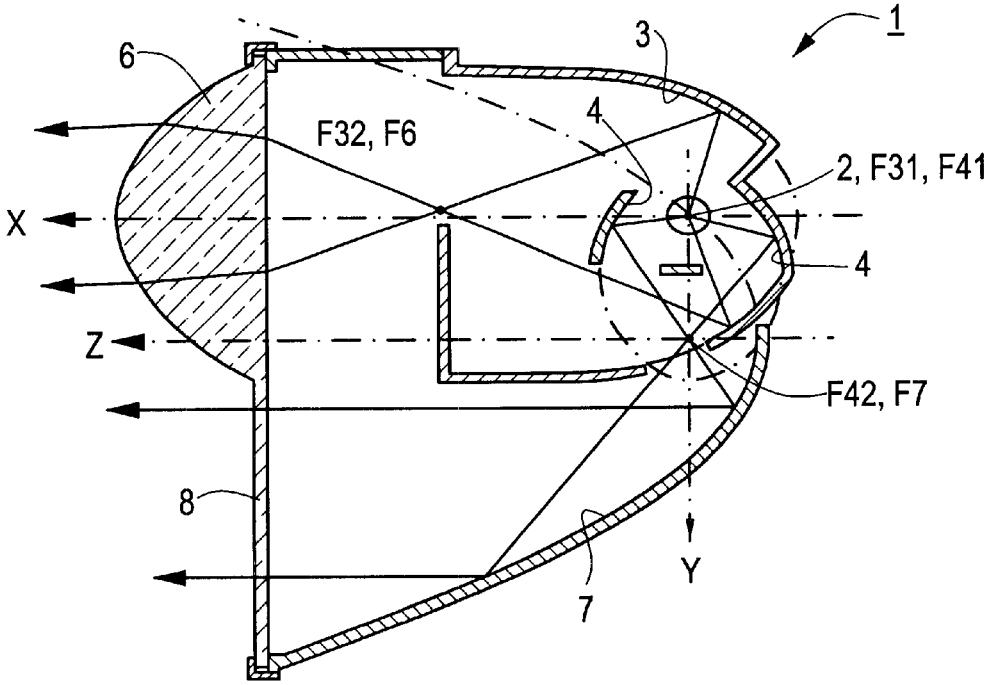
FIG. 5 is a sectional view along line II—II in FIG.4.

Accordingly, a second embodiment shown in FIG. 4 and FIG. 5 has the constitution that the major axis Y of the second elliptic system reflecting surface 4 is set so as to direct toward the lower to the illuminating axis X (refer to FIG. 5), therefore, the parabolic system reflecting surface 7 is arranged on the lower of the first elliptic system reflecting surface 3, and a front shape of the head lamp 1 in this second embodiment has the reversed shape of the first embodiment, in which the projection lens 6 is provided on the upper and the lens 8 is provided on the lower thereof as shown in FIG. 4.

Figure 6:
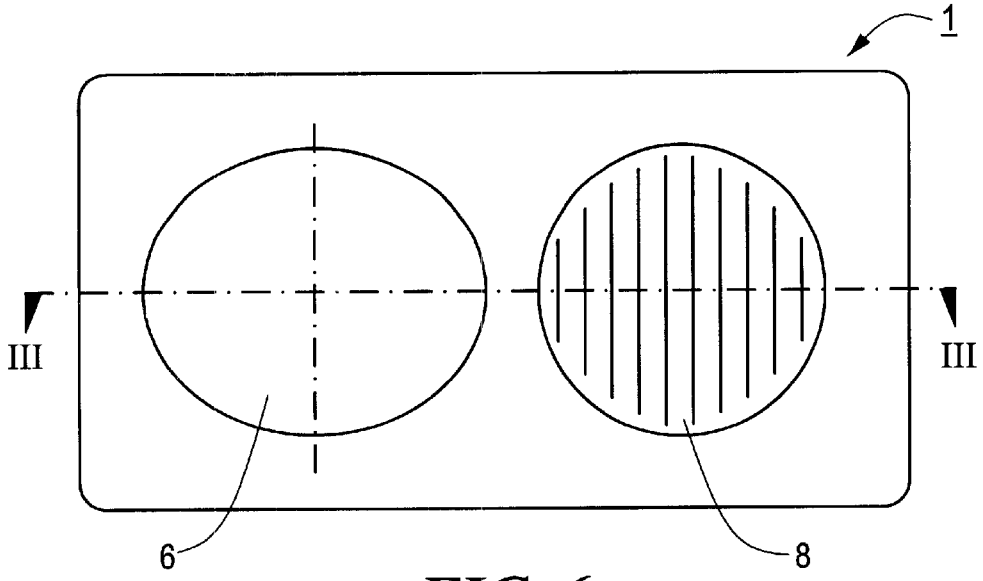
FIG. 6 is a front elevation showing a third embodiment of the head lamp for the vehicle according to the invention.
Figure 7:
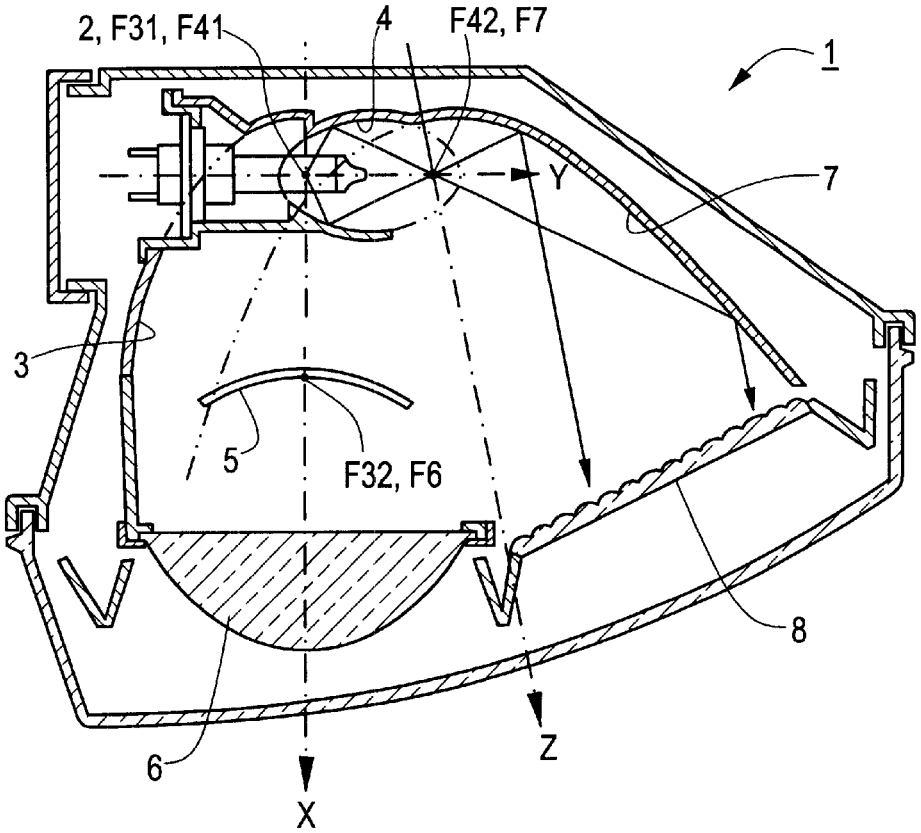
FIG. 7 is a sectional view along line III—III in FIG. 6.

A third embodiment shown in FIG. 6 and FIG. 7 has the constitution that the major axis Y of the second elliptic system reflecting surface 4 is set so as to direct toward the side to the illuminating axis X (refer to FIG. 7), in which the parabolic system reflecting surface 7 is arranged on the side of the first elliptic system reflecting surface 3, and a front shape of the head lamp 1 in the third embodiment has the shape that the projection lens 6 and the lens 8 are arranged horizontally as shown in FIG. 6.

Moreover, in a third embodiment, it is shown in the example of the case where inclining axis Z of the parabolic system reflecting surface 7 within the horizontal plane. As is apparent from the first embodiment to the third embodiment described above, in the head lamp according to the invention, the utilization factor of luminous flux to the light source 2 can be improved, and the bright head lamp not only can be realized, but also flexibility is increased, whereby conformability for a vehicle design can be improved in the appearance shape as described above.

Figure 8:
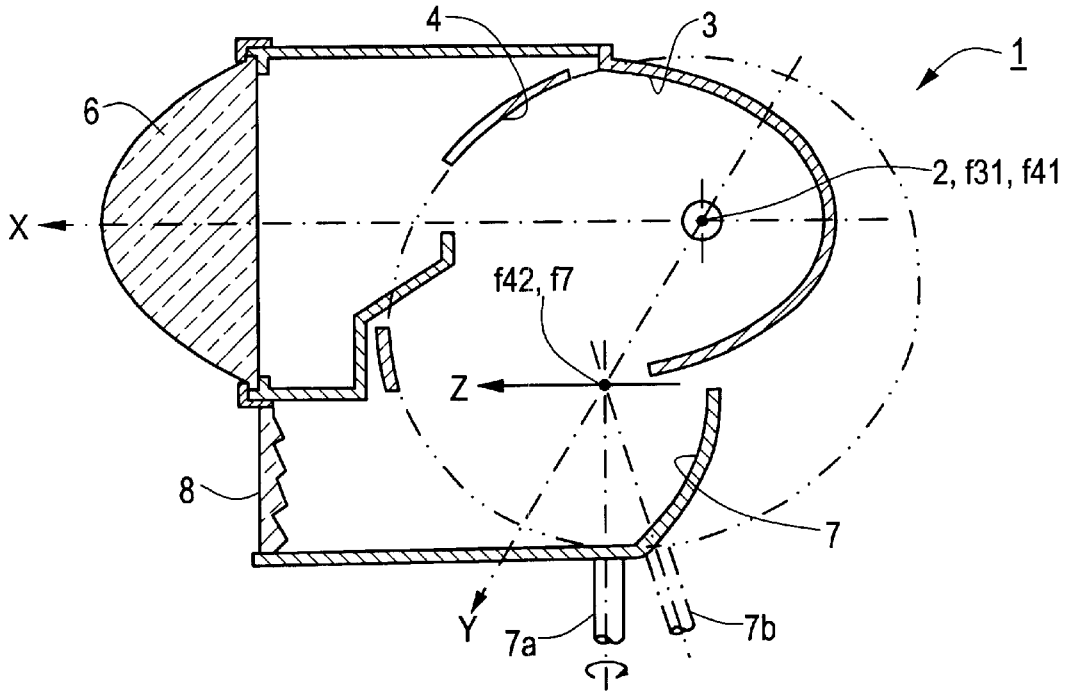
FIG. 8 is, similarly, a front elevation showing a fourth embodiment of the head lamp for the vehicle according to the invention.
Figure 9A:
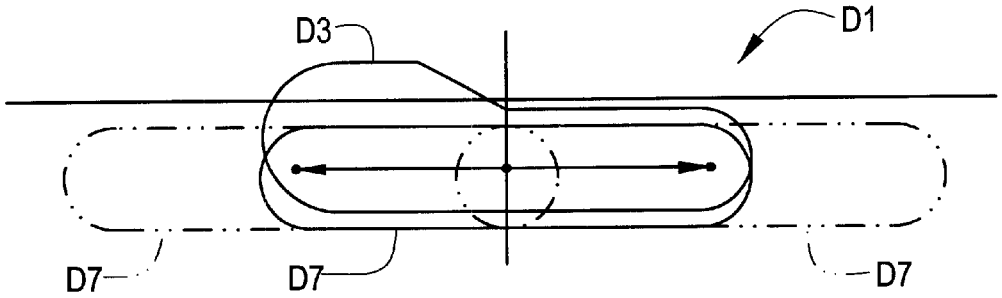
FIG. 9 is an illustration schematically showing the light-distribution characteristic of the fourth embodiment.
Figure 9B:
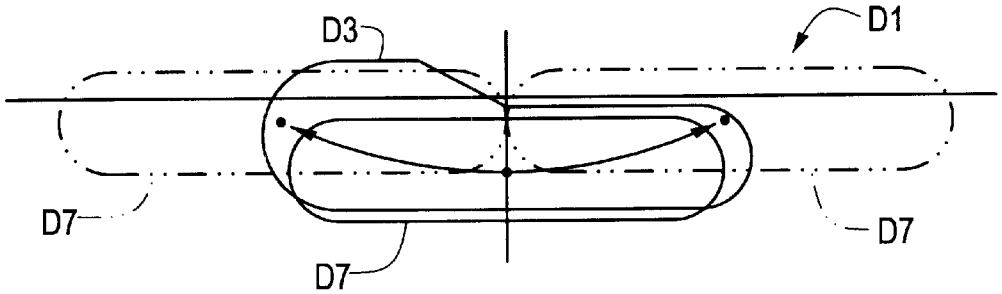
Figure 10:
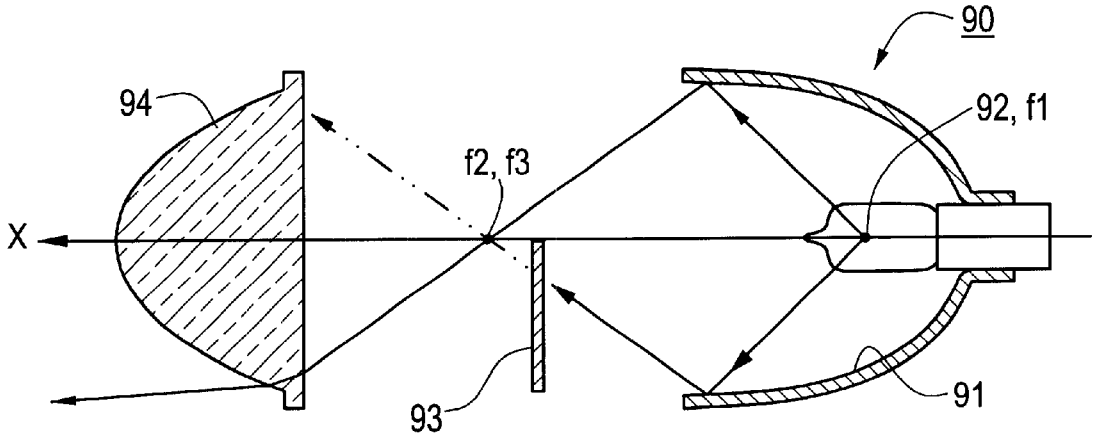
FIG. 10 is a sectional view showing a prior example.

FIG. 8 and FIG. 9 are views showing a fourth embodiment of the head lamp 1 according to the invention, and in this fourth embodiment, the constitution is realized that a revolving axis 7*a* is provided on the parabolic system reflecting surface 7 to interlock this revolving axis 7*a* with a steering system or the like, for example, and to revolve as required, utilizing that the direction of the light-distribution characteristic D7 produced by this parabolic system reflecting surface 7 can be set freely by changing the direction of axis Z of the parabolic system reflecting surface 7 as described above in the first embodiment.

According to this constitution described above, the light-distribution characteristic D7 would illuminate the driving direction thereafter corresponding to the steering operation as shown in the drawings when the vehicle passes through a curved road, whereby the driving direction can be recognize visually easily. Moreover, the light-distribution characteristic D7 is shifted in the up-and-down direction as well as in the right and left direction as shown in FIG. 9 in the vehicle such as a motercycle or the like of which body inclines at turning when the revolving axis 7*a* is set obliquely in advance as shown by chain lines in FIG. 8, whereby it can be corrected the phenomenon that a lamp unit is port 3d is directed downwardly due to the inclination of the vehicle body described above, whereby the illuminating distance is shorten. Moreover, the illuminating direction described above also can be changed by unifying the second elliptic system reflecting surface 4 and the parabolic system reflecting surface 7 to revolve these two surfaces of the reflecting surface 4 and 7 taking the light source as the center.

As described above, according to the invention, it can be realized a head lamp for a vehicle wherein a first elliptic system reflecting surface having an optical axis in the illuminating direction of the head lamp and arranging a primary focus on the light source; and a second elliptic system reflecting surface arranging the primary focus on the same light source and intersecting the optical axis at approximately right angle to the optical axis of the first elliptic system reflecting surface are provided, the projection lens, corresponding to the secondary focus of the first elliptic system reflecting surface and the shield plate, as required are provided, and a parabolic system reflecting surface approximately taking the secondary focus as a focus, corresponding to the secondary focus of the second elliptic system reflecting surface and the shield plate and taking the optical axis as the approximately illuminating direction is provided, whereby the light shielded by the shield plate and the light from the light source which can not reach the reflecting surface and heretofore, has been invalid to form the light-distribution characteristic can be recovered, the utilization factor of luminous flux to the light source can be improved, the bright head lamp also can be realized, and the extremely excellent effect can be performed for improvement of visibility at night driving.

Furthermore, the excellent effect extremely improving performances as the head lamp allowing the subsequent direction to illuminate without losing view of the front direction can be performed by revolving a portion of the reflecting surface such as the parabolic system reflecting surface, moreover, flexibility in an establishment of an vehicle's outward appearance form is increased to improve conformability with design of the vehicle and to perform the excellent effect in improvement of the fine view.

While the presently preferred embodiments of the present invention has been shown and described, it will be understood that the present invention is not limited thereto, and that various changes and modifications may be made by those skilled in the art without departing from the scope of the invention as set forth in the appended claims.

What is claimed is:

1. A head lamp for a vehicle comprising:

a first elliptic system reflecting surface having an optical axis in an illuminating direction of the head lamp and having a primary focus on a light source and a second elliptic system reflecting surface having a primary focus on the light source and intersecting the optical axis of said first elliptic system reflecting surface at approximately a right angle;

a projection lens, placed approximately at a secondary focus of said first elliptic system reflecting surface; and a parabolic system reflecting surface approximately taking the secondary focus of the second elliptical system reflecting surface as its own focus, a shield plate, approximately taking the optical axis as the illuminating direction, is provided.

2. The head lamp for the vehicle according to claim 1, wherein said parabolic system reflecting surface is designed to revolve freely at least in a horizontal direction, having a secondary focus of said second elliptic system reflecting surface as an approximate center of rotation.

3.The head lamp for the vehicle according to claim 2, further comprising a shutter in the path of reflected light from the second elliptic system reflecting surface to said parabolic system reflecting surface and capable of being opened and closed freely, said shutter being at the vicinity of the secondary focus of said second elliptic system reflecting surface.

4. The head lamp for the vehicle according to claim 1, wherein said parabolic system reflecting surface and the second elliptic system reflecting surface are designed to revolve freely at least in the horizontal direction, having a position of said light source as a center of rotation.

5. The head lamp for the vehicle according to claim 1, further comprising a shutter in the path of reflected light from the second elliptic system reflecting surface to said parabolic system reflecting surface and capable of being opened and closed freely, said shutter being at the vicinity of the secondary focus of said second elliptic system reflecting surface.

* * * * *

UNITED STATES PATENT AND TRADEMARK OFFICE

CERTIFICATE OF CORRECTION

PATENT NO. : 6,454,448 B2
DATED : September 24, 2002
INVENTOR(S) : Hitoshi Taniuchi et al.

It is certified that error appears in the above-identified patent and that said Letters Patent is hereby corrected as shown below:

Column 2,
Line 20, “a embodiment” should read -- a second embodiment --; and

Column 6,
Line 37, “focus,” should read -- focus; and --.

Signed and Sealed this

Thirtieth Day of September, 2003

JAMES E. ROGAN
*Director of the United States Patent and Trademark Office*